US005357686A

United States Patent [19]

Jensen

[11] Patent Number: 5,357,686

[45] Date of Patent: Oct. 25, 1994

[54] APPARATUS FOR DRYING A MOIST PARTICULATE MATERIAL WITH SUPERHEATED STEAM

[75] Inventor: Arne S. Jensen, Sovaenget, Denmark

[73] Assignee: Niro Holding A/S, Copenhagen K, Denmark

[21] Appl. No.: 956,484

[22] PCT Filed: Jul. 8, 1991

[86] PCT No.: PCT/DK91/00196

§ 371 Date: Jan. 5, 1993

§ 102(e) Date: Jan. 5, 1993

[87] PCT Pub. No.: WO92/01200

PCT Pub. Date: Jan. 23, 1992

[30] Foreign Application Priority Data

Jul. 9, 1991 [DK] Denmark ..... 1651/90

[51] Int. Cl.[5] ..... F26B 3/10; F26B 17/10

[52] U.S. Cl. ..... 34/169; 34/589; 34/86

[58] Field of Search ..... 34/57 R, 57 A, 57 C, 34/165, 167, 168, 169, 177, 64, 57 E

[56] References Cited

U.S. PATENT DOCUMENTS 4,813,155 3/1989 Jensen ..... 34/57 E

FOREIGN PATENT DOCUMENTS 153704 9/1985 European Pat. Off. .

*Primary Examiner*—Henry A. Bennet

*Attorney, Agent, or Firm*—Watson, Cole, Grindle & Watson

[57] ABSTRACT

An apparatus for drying a moist particulate material having a nonuniform particle size with superheated steam, which apparatus comprises a cylindrical vessel (2) comprising a number of parallel, substantially vertical elongated chambers (6) located in ring form, one or more of the chambers (7) having a closed bottom and the remaining chambers having a steam-permeable bottom (8), wherein means for emitting flows of superheated steam substantially parallel to the chamber bottom (8) are located at the lowermost portion of at least some of the chambers (6) having steam-permeable bottoms (8).

5 Claims, 6 Drawing Sheets

APPARATUS FOR DRYING A MOIST PARTICULATE MATERIAL WITH SUPERHEATED STEAM

BACKGROUND OF THE INVENTION

1. Field of the Invention

The present invention relates to an apparatus for drying a moist particulate material having a non-uniform particle size with superheated steam, which apparatus comprises a cylindrical vessel comprising a number of parallel, substantially vertical elongated chambers located in ring form, one or more of the chambers having a closed bottom and the remaining chambers having a steam-permeable bottom, the adjacent chambers being interconnected through openings in the chamber walls at the lower ends of the chambers and the upper ends of the chambers being connected with a transfer zone, means for supplying moist particulate material to a chamber having a steam-permeable bottom, means for discharging dried material from a chamber having a closed bottom, means for supplying superheated steam to the area below the steam-permeable chamber bottoms, means for discharging steam from the transfer zone, and means for reheating the discharged steam and recirculating it to the area below the steam-permeable chamber bottoms.

2. The Prior Art

An apparatus of the type mentioned above is disclosed in EP patent specification No. 0153704. This prior art apparatus is particularly suitable for drying beet pulp formed by extracting sugar from sugar beet slices with water, but the apparatus is also suitable for removing liquid, including other liquids than water, from a number of sensitive organic materials.

The prior art apparatus presents the advantage that the particulate material is dried without the access of air, thereby making it possible to avoid oxidation of the material during drying. Another important advantage of the apparatus is that it is environmentally highly acceptable as the drying takes place in a substantially closed system. Furthermore, the excess amount of steam, which, e.g., is generated when drying beet pulp, is very pure and consequently it can be used for the concentration of sugar juice, and the condensate thus formed does not cause odor nuisances as compared to the emission products formed by, e.g., drum-drying beet pulp.

When drying particulate, water-containing organic materials it is important to obtain a high dry matter content, e.g. above 90%, in all parts of the material to ensure the storability of the dried material.

In other words it is not sufficient to obtain a material which on the average has a high dry matter content.

When drying particles having different particle sizes in an apparatus of the type mentioned above, the lightest particles are preferably dried in the upper portion of the drying chambers, whereas the coarse particles primarily are dried at the bottom of these chambers while moving from chamber to chamber via the holes in the lowermost portion of the chamber walls.

In practice it has been found that the coarse part of the material sometimes passes so quickly through the prior art apparatus that part of the large particles is insufficiently dried before reaching the discharge chamber. It has been attempted to solve this problem by increasing the ratio of steam to moist material but this has resulted in an undesired increase in energy consumption.

It has also been attempted to increase the retention time of the material in the drying chambers by reducing the holes in the chamber walls in the flow direction of the material, but this has increased the risk that the material forms coatings on the walls of the drying chambers and that the flow of material is gradually blocked.

The object of the present invention is to obtain a dried particulate material wherein substantially all particles have obtained a desired high dry matter content at a moderate energy consumption.

SUMMARY OF THE INVENTION

According to the invention this object is obtained with an apparatus of the type mentioned above, which apparatus is characterized in that means for emitting flows of superheated steam substantially parallel to the bottoms of the chambers are located in the lowermost portion of at least some of the chambers having steam-permeable bottoms.

The invention is based on the discovery that by introducing part of the superheated steam into the chambers having steam permeable bottoms in the form of flows moving parallel to the chamber bottoms it is possible to affect the movement of the material in the individual chambers in such a manner that the coarse particles are retained in each chamber in a desired period and so that, by and large, all particles have obtained a desired high dry matter content before they leave the last drying chamber and move into the discharge chamber.

In order to obtain a satisfactorily dried product when drying sugar beet slices, it is ordinarily desirable to increase the retention time of the material in the last drying chambers, and this is achieved by directing the flows of steam towards the openings in the chamber walls on the up-stream side.

The material may tend to accumulate in the first drying chambers and in these chambers it may, therefore, be desirable to use flows of steam directed towards the openings in the chamber walls on the down-stream side and hence to reduce the retention time of the material in these chambers.

As will appear from the above discussion such means may, in some cases, be used for increasing and in some cases for decreasing the retention time of the material in the-chambers, and in the very same apparatus means may be provided for reducing the retention time of the material in some of the chambers while increasing it in others. Furthermore, such means may be omitted in some of the drying chambers. The flows of steam generated by the means mentioned above affect not only the retention time of the material but they do also supply heat energy to the material, and the provision of these flows of steam do, therefore, not result in an unsatisfactory heat economy.

FIG. 1 in the drawing illustrates, cf. the following explanation, the relationship between relative amount of material and retention time when drying sugar beet slices in an apparatus according to the invention.

As will appear from FIG. 1 the retention time of the major part of the material is short and uniform, and it has been found that even in case of such a relatively short retention time it is possible to obtain a uniform and sufficient drying of all the particles.

A particularly preferred embodiment of an apparatus according to the invention which comprises a spacer element having an upper side which inclines downwardly and outwardly, the spacer element being located in the central part of each chamber having a steam-permeable bottom, is characterized in that the underside of the spacer element is located a short distance above the bottom of the chamber and that guide means are provided in the area between said underside and the bottom of the chamber.

In this embodiment of the apparatus according to the invention part of the steam supplied to the area below the steam-permeable chamber bottoms will move up into the area below the spacer elements and from this area it will be guided by means of the guide means, such as guide blades, in a direction corresponding to the position of the guide means, in the form of flows of steam.

Several guide means in the form of guide blades are preferably located in each chamber. The guide means may be attached to the underside of the spacer element or to the bottom of the chamber, and in a particularly preferred embodiment of the invention their angular position is adjustable.

The guide means may, e.g., be connected with adjusting means which can be operated from the outside of the apparatus. This particularly preferred embodiment allows the angular position, and hence the forward movement of the material, to be adjusted according to the characteristics of the starting material, e.g. liquid content, particle size, heat sensitivity, and the like.

When drying a water-containing particulate material superheated steam is used, whereas superheated vapour of the liquid present in the material is used when drying material containing a non-aqueous liquid.

BRIEF DESCRIPTION OF THE DRAWINGS

The invention will now be described in further detail with reference to the drawings in which.

DETAILED DESCRIPTION OF THE PREFERRED EMBODIMENTS

Figure 1:
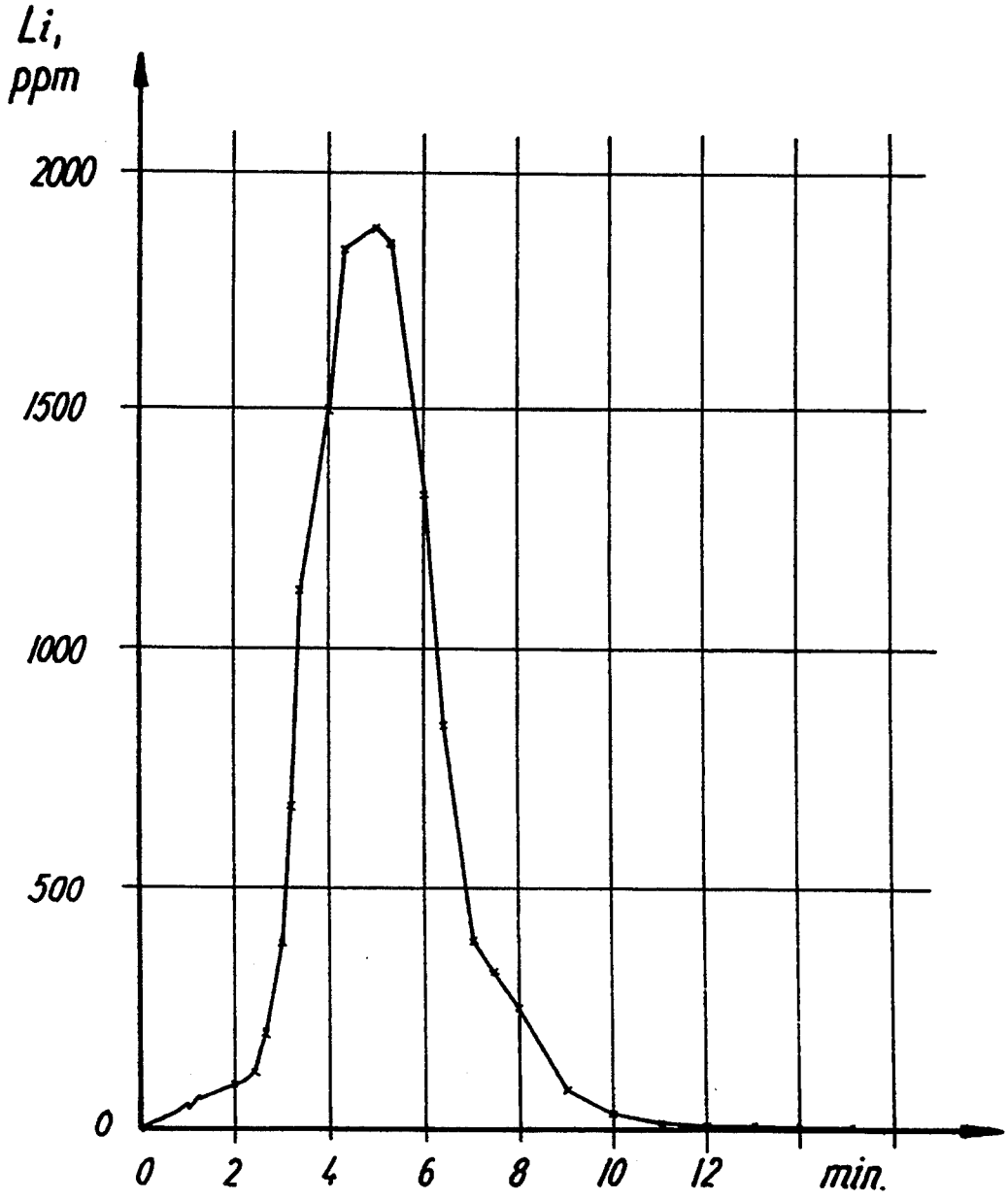
FIG. 1 shows a curve illustrating the relationship between the relative amount of material and the retention time of the material when drying sugar beet slices in an industrial apparatus according to the invention.
Figure 2:
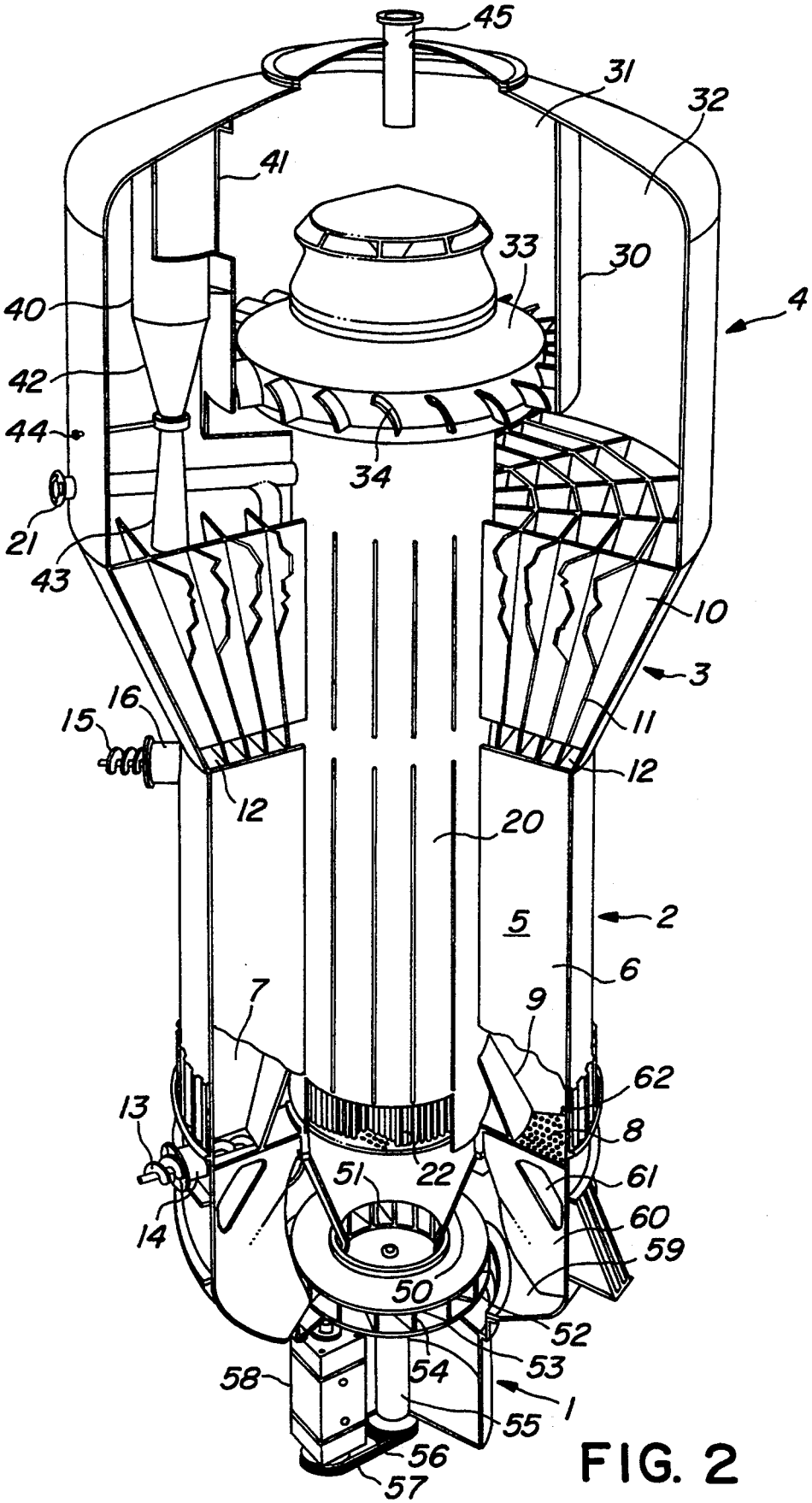
FIG. 2 shows a perspective and partially sectional view of a preferred embodiment of an apparatus according to the invention.
Figure 3:
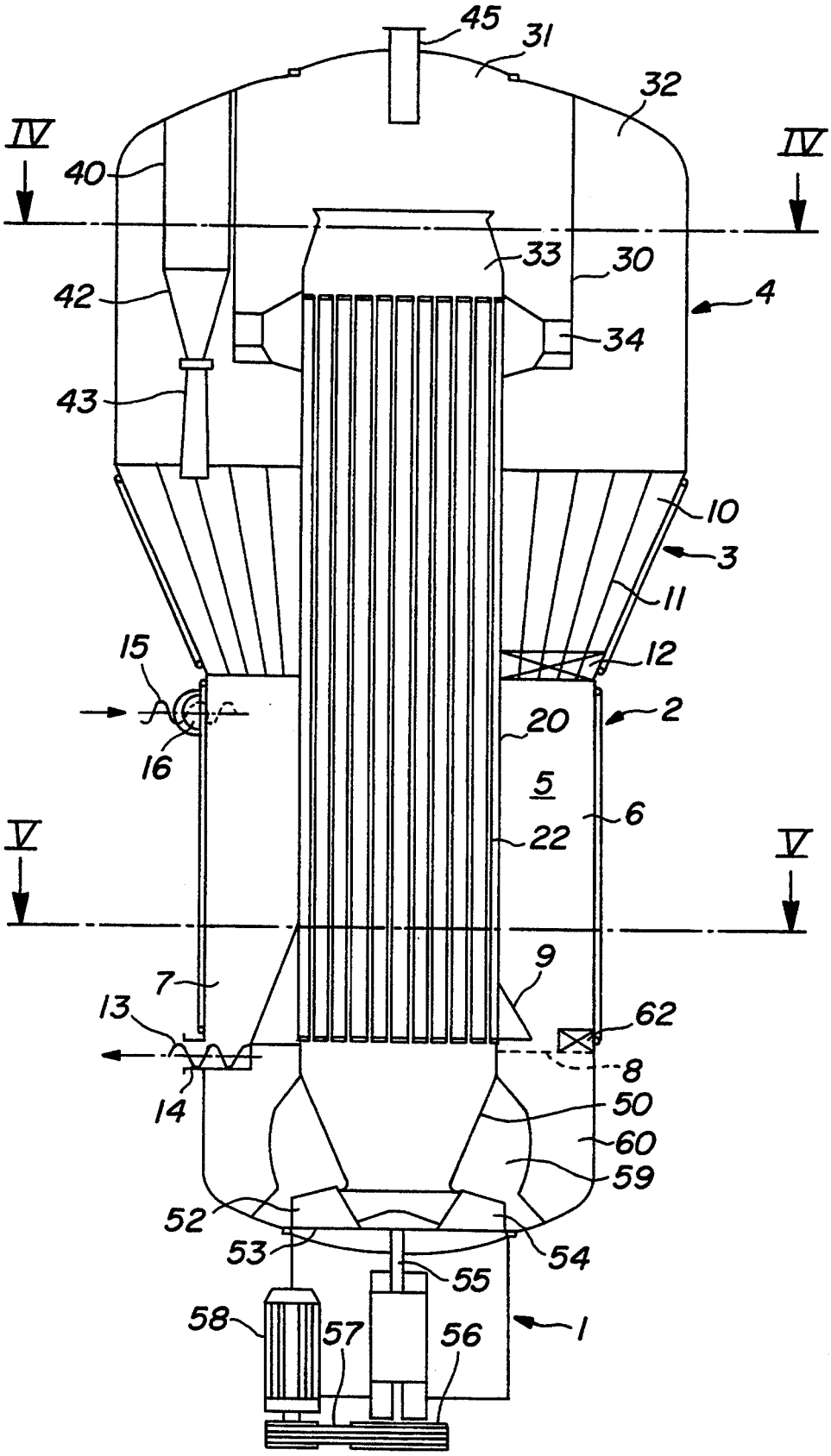
FIG. 3 shows a vertical sectional view of an apparatus according to FIG. 2.
Figure 4:
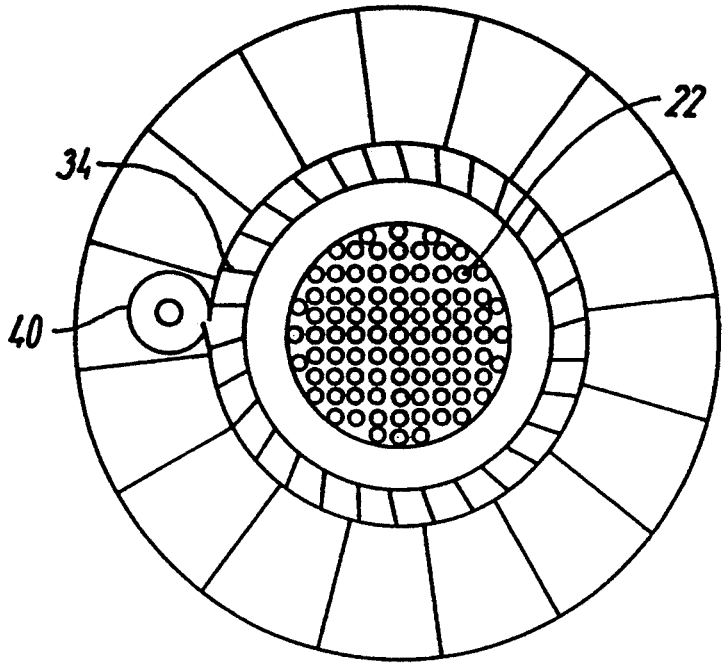
FIG. 4 shows a horizontal sectional view along the line IV—IV through the apparatus according to FIG. 3.
Figure 5:
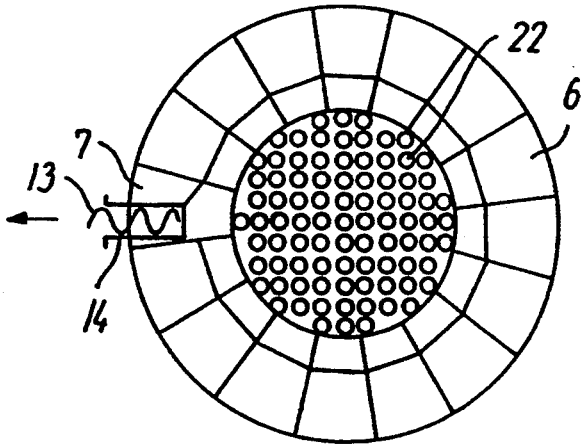
FIG. 5 shows a horizontal sectional view along the line V—V through the apparatus according to FIG. 3.
Figure 6:
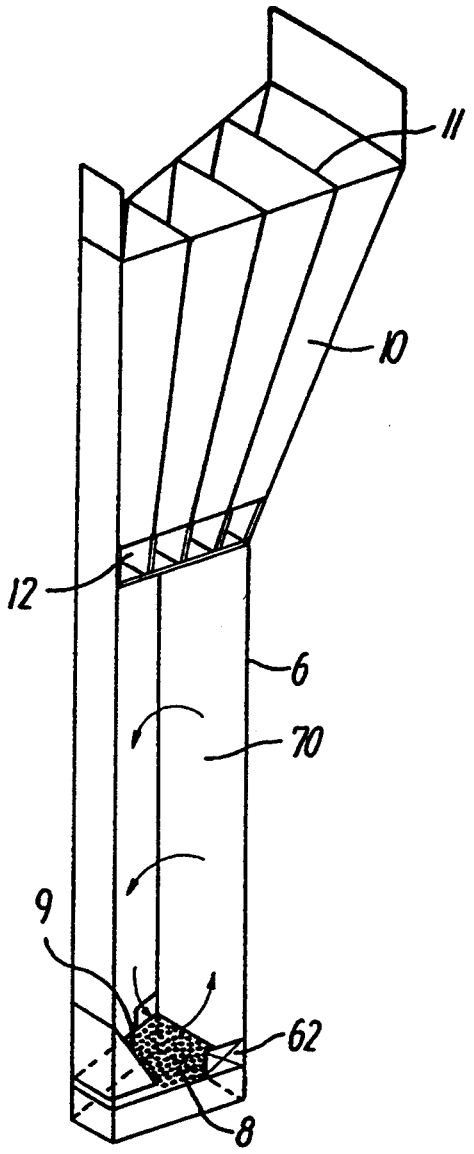
FIG. 6 shows a schematic perspective view of a drying chamber in an apparatus according to the invention.
Figure 7:
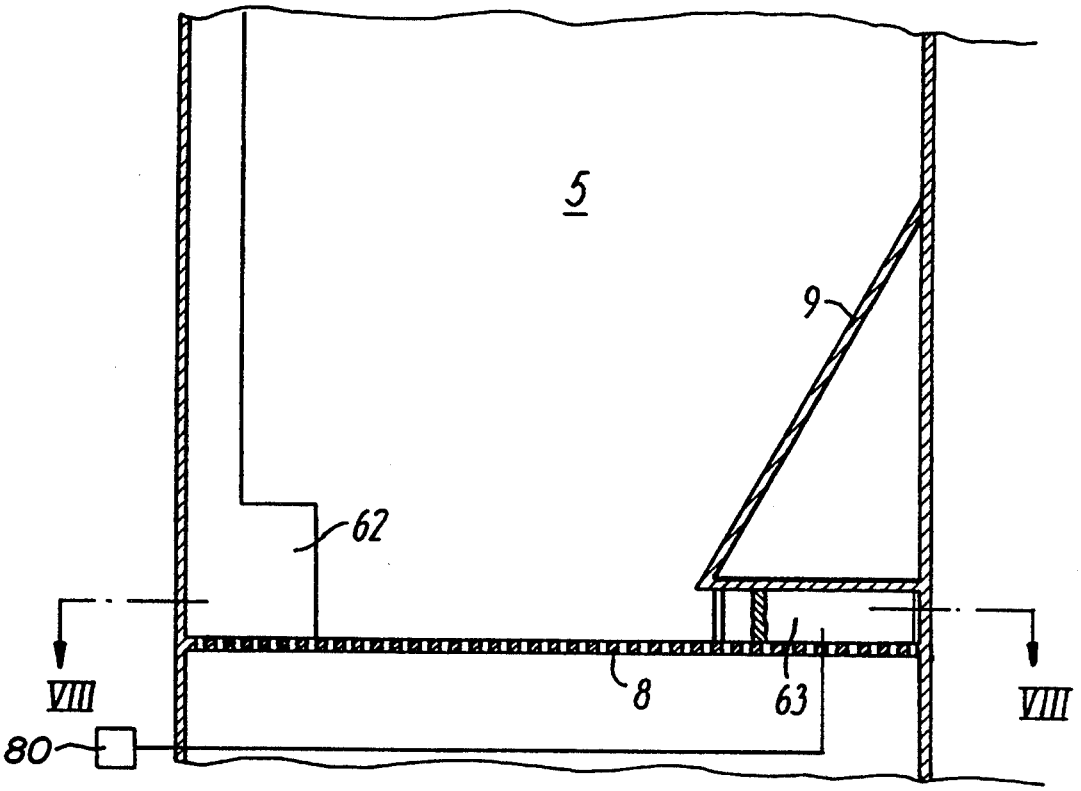
FIG. 7 shows a vertical sectional view of the lowermost part of a drying chamber in an apparatus according to the invention.

The curve shown in FIG. 1 illustrates the result of a test performed by adding a given amount of lithium chloride to a given amount of sugar beet slices and by measuring, at intervals, the lithium content of the material discharged from the apparatus and by depicting the Li-content expressed as ppm Li as a function of time.

As will appear from FIG. 1, none of the sugar beet slices remained in the apparatus for a period of more than 12 minutes, and the retention time of the major part of the sugar beet slices was between 3 and 7 minutes. The apparatus shown in the drawing comprises a bottom part generally designated 1, a cylindrical part generally designated 2, a conical part generally designated 3 and a top part generally designated 4.

The cylindrical part 2 is divided into fifteen drying chambers 6, which are connected in series, by means of vertical chamber walls 5, and a discharge chamber 7 is located between the first and the last drying chamber 6. At the bottom the drying chambers 6 are delimited by a perforated chamber bottom 8 and a spacer element 9 is located centrally above the chamber bottom 8, the spacer element having an upper side which inclines downwardly and outwardly and an underside which is located a short distance above the perforated chamber bottom 8. The drying chambers 6 extend into the conical part 3 of the apparatus, each drying chamber 6 being divided into downwardly-tapering smaller chambers 10 by inclined separating plates 11 which are provided with heating members (not shown). Adjacent drying chambers 6 and the discharge chamber 7 are interconnected in the transition zone between the cylindrical part 2 and the conical part 3 via openings 12 in the chamber walls 5.

A screw conveyor 13 which is mounted rotatably in a discharge pipe 14 is located at the bottom of the discharge chamber 7. The upper portion of the cylindrical part 2 of the apparatus is provided with a corresponding screw conveyor 15 located in a feed pipe 16 debouching into the upper portion of the first drying chamber 6.

A pipe heat exchanger 20 fills the central portions of the cylindrical part 2, the conical part 3 and in part the top part 4, the heat exchanger being connected to a pipe 21 for supplying superheated steam which, as explained below, is passed from the top part 4 to the bottom part 1 of the apparatus via a large number of heat exchanger pipes 22 while at the same time being heated by the superheated steam supplied through the pipe 21. Furthermore, the heat exchanger 20 is connected to a pipe (not shown) for discharging condensate from the area around the pipes of the heat exchanger 22.

The top part 4 is divided into a central chamber 31 and a transfer chamber 32 by means of a plate 30. A stationary filling element 33 is provided in the central chamber 31 at the upper end of the heat exchanger 20, the outside of the filling element 33 being provided with a number of guide blades 34 having such a shape and spacing that a cyclone field is formed in the space within the plate 30 by steam passing from the transfer chamber 32 up through the space between the filling element 33 and the plate 30.

The plate 30 abuts with a cyclone 40 and the central chamber 31 is connected with the interior of the cyclone 40 through an opening 41 in the plate 30 and in the cyclone 40. The latter has a conical lower portion 42 passing into a slightly funnel-shaped portion 43 debouching into one of the chambers 10 in the discharge chamber 7. In the transition zone between the conical lower portion 42 and the funnel-shaped portion 43 a pipe 44 is provided for supplying a gas under pressure to produce an ejector effect in the transition zone between the lower conical portion 42 of the cyclone and the funnel-shaped portion 43.

A pipe 45 for discharging excess steam is provided at the top of the top part 4 of the apparatus.

The bottom part 1 of the apparatus comprises a funnel-shaped portion 50 extending downwardly from the lower end of the heat exchanger 20 into the interior of a centrifugal blower 51 comprising a rotor consisting of two circular plates 52 and 53 having blades 54 mounted between the plates.

The rotor 51 is mounted on a shaft 55 having a wedge belt gear 56 which drives a motor 58 via a pair of V-belts 57. The rotor 51 is surrounded by a steam distribution chamber 59 wherein guide plates 60 having holes 61 formed therein are located.

As will appear from FIGS. 3, 6, 7 and 8, the chamber walls 5 of the drying chambers 6 are provided with holes 62 through which non-dried material can pass from one drying chamber 6 to another. These holes 62, or some of the holes, decrease in size in the flow direction of the material, cf. FIG. 8 in which the direction of movement of the material is indicated with an arrow 71.

Figure 8:
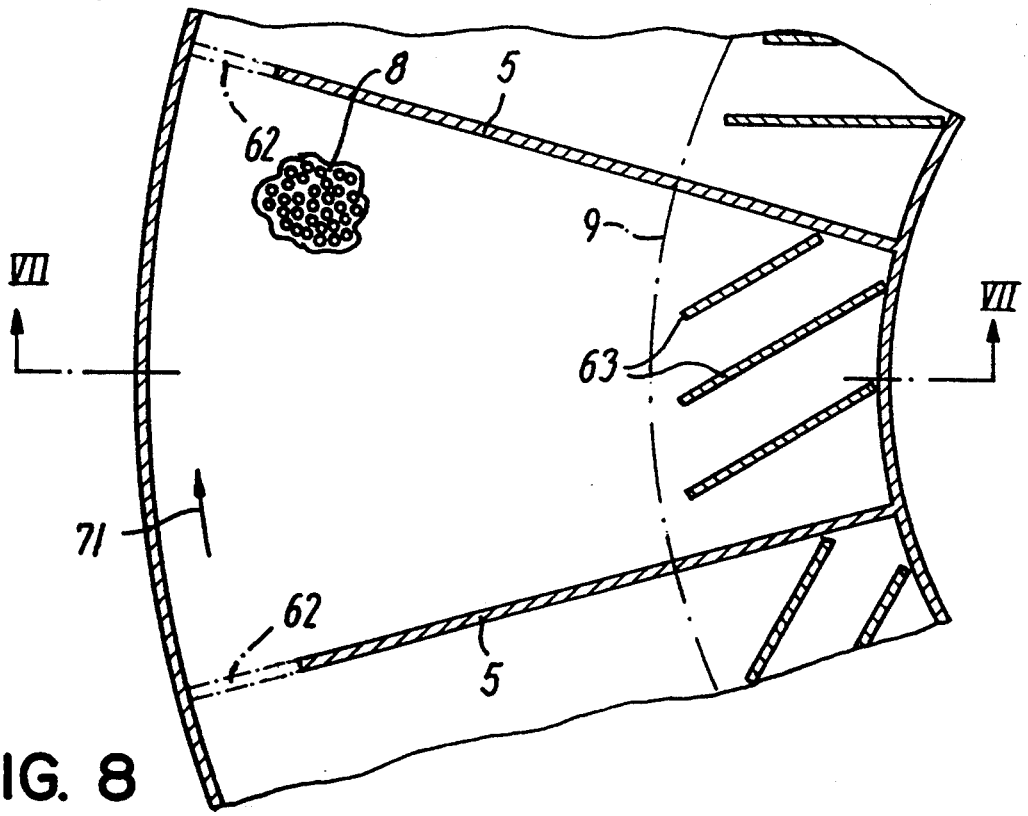
FIG. 8 shows a horizontal sectional view along the line VIII—VIII of the drying chamber according to FIG. 7.

As will also appear from FIG. 8, the underside of the filling element 9 is provided with guide blades 63 which serve to direct superheated steam passing up through the perforated chamber bottoms in a direction towards the holes 62 of the chamber wall 5 on the up-stream sides of the chambers in the form of horizontal flows of steam.

The apparatus operates in the following way:

Particulate starting material is conveyed into the upper portion of the first of the drying chambers 6 connected in series by means of the screw conveyor 15 and the feed pipe 16. In the drying chamber the material supplied is subjected to the influence of superheated steam which is supplied to the drying chamber through the perforated bottom 8. The spacer elements 9 impart a whirling movement to the material as indicated with the arrows 70 in FIG. 6. Part of the material will be too heavy to remain suspended and will move towards the chamber bottom 8. During the downward movement, which primarily takes place in the central part of the chamber, the material will hit the inclined upper side of the spacer element 9 and slide down this side.

On passing the lowermost end of the spacer element 9 the material will be influenced by flows of steam formed by the superheated steam passing through the chamber bottom below the spacer element 9 and which are directed towards the chamber wall 5 of the adjacent drying chamber 6 by guide blades 63, thereby causing part of this relatively coarse material to pass into the next (second) drying chamber 6 via the hole 62 in the chamber wall 5. The angular position of the guide means 63 can be adjusted from outside the apparatus by means 80 (see FIG. 7).

The relatively coarse material introduced into the second drying chamber 6 will be directed towards the third drying chamber in the same manner, and so on.

During the drying of the material in the chambers 6 the particles will gradually lose weight and the lightest particles will pass up into the conical part 3 of the apparatus. Having reached that part of the apparatus, part of the material will settle on the upper side of the separating plates 11 where the upward-moving gas flow is weak. Hence the material will be further heated and dried, and in a dried state it will slide down towards the cylindrical part 2 of the apparatus and through the openings 12 flow into a subsequent chamber, and so on.

The large particles will primarily remain in the lowermost portion of the chambers in which their movement will be affected by the flows of steam formed by the guide blades 63.

In practice it has been found that more than 90% of the material (on a dry matter basis) is conveyed through the openings 62 at the lower ends of the chambers and through the openings 12 in the transition zone between the conical part 3 and the cylindrical part 2. Thus, only a relatively small part of the material passes into the transfer zone and the greater part of this passes up into the central chamber 31.

There will be no upward-moving flow of steam in the area above the discharge chamber 7 because the bottom of this chamber is closed, and when passing into the discharge chamber 7 the dry particles will move towards the bottom of this chamber.

The material which is introduced into the discharge chamber 7 through the holes 62 at the lowermost ends of the drying chambers, through the openings 12 in transition zone between the cylindrical part 2 and the conical part 3 or through the transfer chamber 32 is discharged at the bottom of the discharge chamber 7 by means of the screw conveyor 13 mounted in the discharge pipe 14.

From the transfer chamber 32 the flow of steam from the drying chamber 6 will pass up into the central chamber 31 and thereby pass the guide blades 34 which impart a whirling movement to the flow of steam along the inner side of the plate 30, thereby causing entrained particles to be directed towards the plate 30, and on passing the opening 41 the particles will be fed into the cyclone 40, wherein they will settle at the bottom of the cyclone, and from the cyclone they will be introduced into the discharge chamber 7 by the supply gas through the pipe 44.

The steam liberated from solid particles is pumped from the central chamber 31 down through the heat exchanger 20 by means of the centrifugal blower 51. During the passage through the heat exchanger 20 the steam is superheated by means of steam or another heating medium which is supplied to the heat exchanger 20 through the pipe 21.

The flow of steam generated in the centrifugal blower 51 is passed through the steam distribution chamber 59 into the area below the perforated chamber bottoms 8 of the drying chambers 6 and from this area up into the drying chambers 6.

Excess steam generated by evaporation of liquid from the particulate material is discharged through the pipe 45 at the top part 4 of the apparatus.

I claim:

1. An apparatus for drying a moist particulate material having a non-uniform particle size with superheated steam, which apparatus comprises a cylindrical vessel comprising a number of parallel, substantially vertical elongated chambers located in ring form, one or more of the chambers having a closed bottom and the remaining chambers having a steam-permeable bottom, the adjacent chambers being interconnected through openings in the walls at lower ends of the chambers and upper ends of the chambers being connected with a transfer zone, means for supplying moist particulate material to a chamber having a steam-permeable bottom, means for discharging dried material from a chamber having a closed bottom, means for supplying superheated steam to an area below the steam-permeable bottoms of the chambers, means for discharging steam from the transfer zone, means for reheating the discharged steam and recirculating it to the area below the steam-permeable bottoms of the chambers, and means for emitting flows of superheated steam substantially parallel to the bottoms of the chambers and in a selected non-radial direction so as to increase or decrease the retention time of the material in the chambers, said emission means being located in the lowermost portion of at least some of the chambers having steam-permeable bottoms.

2. An apparatus according to claim 1 comprising a spacer element in each chamber having a steam-permeable bottom, each said spacer element having an upper side which includes downwardly and outwardly, each said spacer element being located in the central part of a chamber having a steam-permeable bottom, the underside of each spacer element being located a short distance above the bottom of the chamber, and wherein said means for emitting flows of superheated steam substantially parallel to the bottoms of the chambers include guide means located in the area between said underside and the chamber bottom.

3. An apparatus according to claim 2, wherein said guide means consist of one or more guide blades mounted on each underside of the spacer element.

4. An apparatus according to claim 2, wherein said guide means are adjustable.

5. An apparatus according to claim 4, wherein said guide means can be adjusted from the outside of the apparatus.

* * * * *